US006736238B2

(12) United States Patent
Kerr

(10) Patent No.: US 6,736,238 B2
(45) Date of Patent: May 18, 2004

(54) AIR INTAKE SILENCER

(75) Inventor: John David Kerr, Enderby (GB)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/850,315

(22) Filed: May 7, 2001

(65) Prior Publication Data

US 2003/0150671 A1 Aug. 14, 2003

(51) Int. Cl.[7] ..... F01N 1/08

(52) U.S. Cl. ..... 181/267; 181/268; 181/269; 181/270; 181/275; 181/229; 181/264

(58) Field of Search ..... 181/267, 268, 181/269, 270, 275, 229, 264

(56) References Cited

U.S. PATENT DOCUMENTS 2,243,866 A * 6/1941 Kamrath ..... 181/229
4,125,171 A * 11/1978 Morris ..... 181/265
4,204,586 A * 5/1980 Hani et al. ..... 181/229
5,413,189 A * 5/1995 Browning et al. ..... 181/268

* cited by examiner

*Primary Examiner*—Shih-Yung Hsieh
(74) *Attorney, Agent, or Firm*—Woodard, Emhardt, Moriarty, McNett & Henry LLP

(57) ABSTRACT

A silencer for connection to the air intake of a machine such as a turbocharger compressor. The silencer comprises a housing containing a plurality of axially spaced annular noise attenuating baffles. Each baffle has an outer circumference and an inner circumference defining a central aperture, the central apertures of each baffle collectively defining an axial outlet flow passage to an outlet aperture.

The baffles define a series of axially spaced generally annular partial flow passages such that air flowing through the silencer is initially split and then merges into the axial outlet passage. Each of the annular flow passages curves radially inwards from its outer to its inner circumference in a direction towards the axial. Additionally, or alternatively, the dimensions of the annular partial flow passages vary so that the velocity of air flow through the passages is greater for passages closer to the axial outlet aperture.

17 Claims, 3 Drawing Sheets

AIR INTAKE SILENCER

FIELD OF THE INVENTION

The present invention relates to an air intake silencer for attenuating the noise of an air flow into the intake of an aspirated machine. Particularly, but not exclusively, the invention relates to a turbocharger compressor inlet silencer.

BACKGROUND OF THE INVENTION

A conventional exhaust gas turbocharger comprises a compressor driven by a turbine which is itself driven by exhaust gas flow from a reciprocating engine, normally an internal combustion engine. The compressor wheel rotates in a housing to draw in air through an inlet passage and deliver compressed air through an outlet passage to the air intake of the engine. For instance, in an axial compressor the compressor inlet passage is a tubular passage extending from the compressor wheel housing and the outlet passage is an annular volute surrounding the compressor wheel.

It is conventional to fit an inlet silencer to the compressor wheel inlet to attenuate the sound waves produced as air accelerates into the compressor. A typical compressor inlet silencer comprises a cylindrical or conical housing which has a generally annular inlet flow through the walls of the housing and a generally axial outlet flow to the compressor inlet. Noise reduction is achieved by the provision of sound deadening baffles within the silencer housing. Conventional compressor inlet silencer baffles are annular members i.e. disc like with a axial central opening, arranged axially along the axis of the silencer housing (and thus the axis of the compressor wheel) so that the air flowing through the silencer initially flows in a generally radial direction along flow paths defined between adjacent baffles and then turns axially towards the silencer outlet and compressor inlet. The baffles provide a sound attenuating surface which significantly reduces the noise of the air flow into the compressor. The baffles may, for instance, have a composite construction comprising an annular steel plate with cork or felt glued to each side.

Generally silencers are constructed as a combined air silencer/filter module. For instance, a filter membrane may be supported around the silencer housing which defines the annular inlet into the silencer so that the air flow is filtered as it passes radially into the silencer housing.

With any compressor it is important that the intake air flow through the compressor inlet is smooth to enhance the efficiency of the compressor. A problem with conventional compressor inlet silencers as described above is that the merging of the generally radial silencer inlet flow with the generally axial silencer outlet flow produces turbulence in the downstream air supplied to the compressor wheel.

An example of such a combined compressor inlet silencer/filter is disclosed in U.S. Pat. No. 4,204,586. This shows two alternative arrangements of annular baffles of the general type described above. In a first arrangement the baffles each lie in a plane perpendicular to the axis of the silencer whereas in the second embodiment the baffles have a frusto-conical configuration so that their noise attenuating surfaces lie at an angle to the axis of the silencer. In each case the inner circumference of the baffles curve inwardly towards the axial silencer outlet in an attempt to deflect the generally radial inlet flows into the axial outlet flow. In addition, the separation of the baffles, which are arranged equidistantly along the axis of the silencer, is such that the sum of the cross-sections of the partial flow passage as defined between the baffles is approximately equal to the average flow cross-section of the silencer manifold delivering air to the compressor inlet. Both of these features are provided to promote smooth merging of the radial air flow with the axial silencer outlet flow to reduce turbulence both within the silencer housing and in the air stream fed to the compressor.

SUMMARY OF THE INVENTION

It is an object of the present invention to provide a silencer design which further reduces turbulence in the air flow from the silencer to the intake of the downstream machine (such as a compressor or the like) and which has improved sound attenuating characteristics.

According to a first aspect of the present invention there is provided a silencer for connection to the air intake of a machine, the silencer comprising:

- a housing having an axis, an outlet aperture being defined at one axial end of the housing;
- a plurality of axially spaced annular noise attenuating baffles, each baffle having an outer circumference and an inner circumference defining a central aperture, the central apertures of each baffle collectively defining an axial outlet flow passage to said outlet aperture;
- the baffles defining a series of axially spaced generally annular partial flow passages such that air flowing through said silencer is initially split between said flow passages and then merges into the axial outlet passage;
- wherein each of the annular flow passages curves radially inwards from its outer to its inner circumference in a direction towards the axial outlet.

According to a second aspect of the present invention there is provided a silencer for connection to the air intake of a machine, the silencer comprising:

- a housing having an axis, an outlet aperture being defined at one axial end of the housing;
- a plurality of axially spaced annular noise attenuating baffles, each baffle having an outer circumference and an inner circumference defining a central aperture, the central apertures of each baffle collectively defining an axial outlet flow passage to said outlet aperture;
- the baffles defining a series of axially spaced generally annular partial flow passages such that air flowing through said silencer is initially split between said flow passages and then merges into the axial outlet passage;
- wherein the dimensions of the annular partial flow passages varies so that the velocity of air flow through the passages is greater for passages closer to the axial outlet aperture.

Advantages resulting from both the first and second aspects of the invention are described further below. Preferred embodiments of the invention combine both the first and second aspects of the invention.

Preferably each of the annular flow passages curves radially inwards from its outer to its inner circumference with a curvature which is initially tangential to a radial plane of said axis and which curves away from said plain towards its inner circumference in a direction towards the axial outlet.

Each of the annular flow passages may have a radius of curvature which increases towards the inner circumference of each respective flow passage.

In preferred embodiments of the invention the axial width of successive annular partial flow passages increases progressively along the axis of the housing towards the axial outlet aperture to provide said increasing velocity of air flow through the passages.

It may be possible to group the passages in size so that two or more adjacent passages have the same axial width which differs from that of a neighbouring passage or group of passages. However, the axial width of each annular partial flow passage preferably differs from that of its immediate neighbour or neighbours.

Silencers according to the present invention may be part of a combined air silence/filter.

BRIEF DESCRIPTION OF THE DRAWINGS

Specific embodiments of the present invention will now be described, by way of example only, with reference to the accompanying drawings in which.

DETAILED DESCRIPTION OF THE PREFERRED EMBODIMENTS

Figure 1:
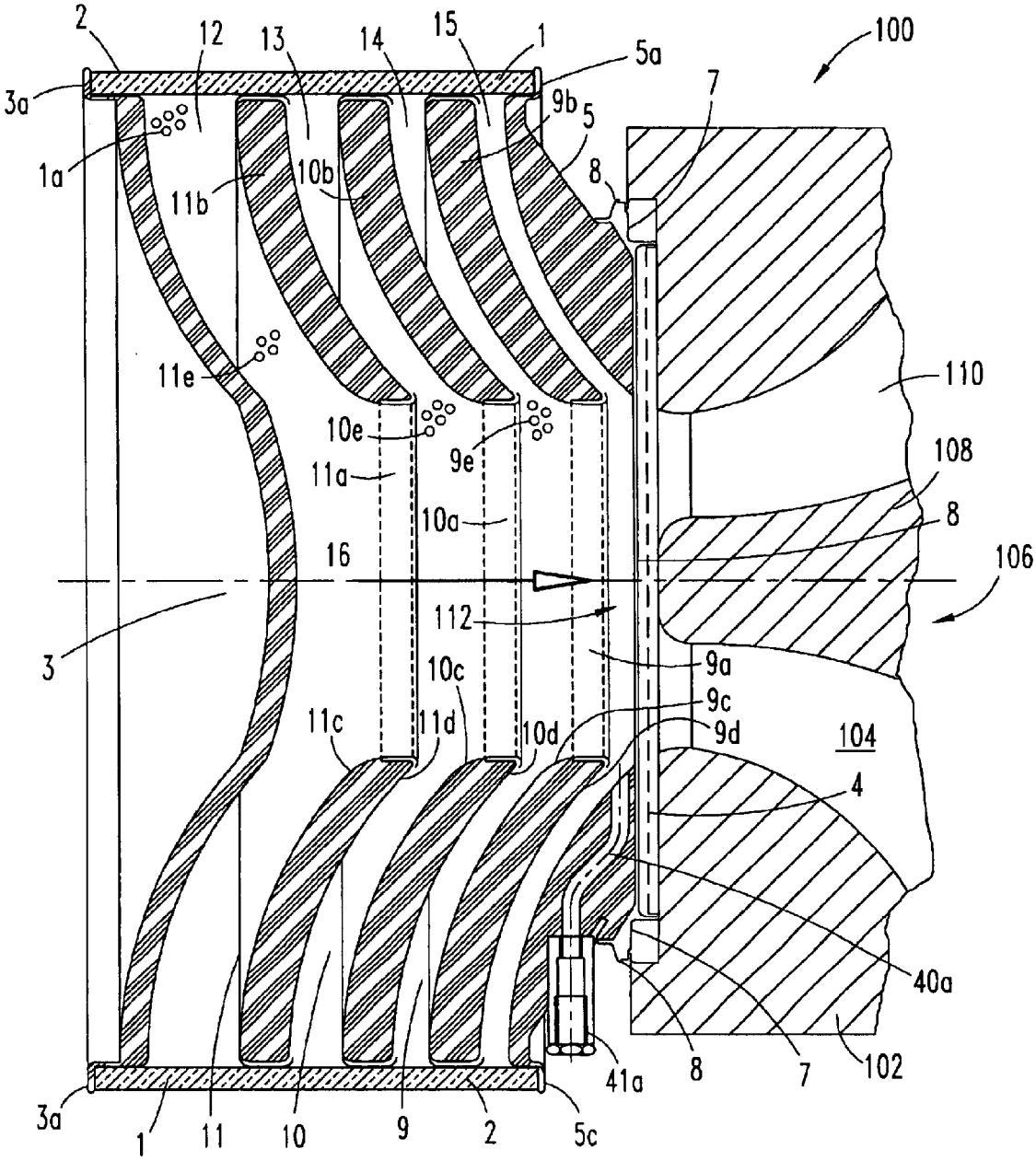
FIG. 1 is an axial section through a generally cylindrical compressor inlet silencer/filter in accordance with the present invention.
Figure 2:
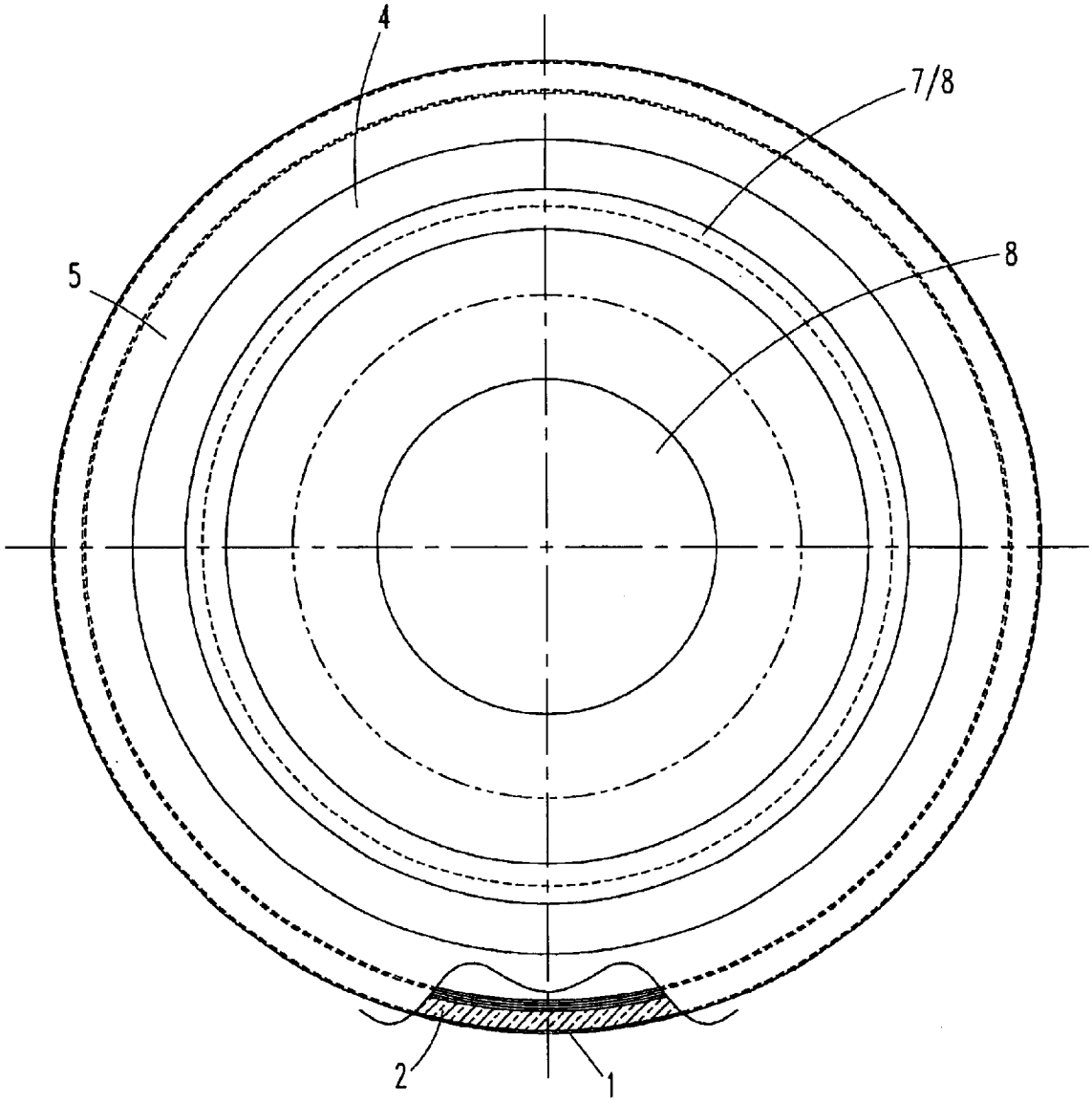
FIG. 2 is an end view of the silencer/filter of FIG. 1 looking in the direction of arrow A of FIG. 1.

Referring first to FIGS. 1 and 2, the illustrated embodiment of the invention is a combined air filter and silencer module for installation at the air intake inlet of a turbocharger compressor generally indicated at 100. Compressor 100 comprises a generally annular housing 102 surrounding an annular flow path 104. A compressor impeller 106 having a hub 108 and blades 110 is journalled for rotation within flow path 104. As noted in FIG. 1, the flow into the inlet 112 of compressor 100 is in an axial direction and it turns radially outward because the compressor is centrifugal. It should be noted, however, that the invention may be equally applied to axial flow machines. It is also noted that FIG. 3 omits the showing of a compressor with the silencer for an ease of understanding the invention. It should be understood that the compressor 100 of FIG. 1 could be, with appropriate sizing, fitted to the silencer and filter of FIG. 3.

The illustrated silencer/filter module comprises a cylindrical casing 1 constructed from a sheet of perforated steel, preferably stainless steel. The perforations 1*a*, only a few of which are shown, permit air to be drawn radially into the casing 1 which thus defines an annular inlet for the silencer/filter module. As illustrated, the perforations 1*a* are circular. It should be noted that they may be in any configuration depending upon the manner of instruction of the casing 1. The outer annular surface of the casing 1 supports a filter membrane 2, which may be of a conventional filter material, so that air is filtered as it is drawn into the casing 1

One end of the casing 1, the left-hand end as viewed in FIG. 1; is closed by an inwardly domed end cap 3. The opposite end of the casing 1 is adapted for attachment to the tubular inlet of the axial compressor 100 and comprises an annular support plate 4 fitted to an end flange 5, which extends radially inwards from the circumference of the casing 1, by way of annular connection rings 7 and 8. The outer surface (with respect to the volume contained by the casing) of the end flange 5 tapers towards the outer circumference of the support plate 4 which has a smaller diameter than the casing 1. The inside surface of the end flange 5 curves radially towards the inner circumference of the support plate 4 defined around a central outlet aperture 8 which in use will communicate with the compressor inlet 112. The end flange 5 also supports a wash pipe 40*a* and wash inlet connector 41*a* to enable cleaning fluid to be flushed through the silencer/filter.

Both the end cap 3 and the end flange 5 have radially outwardly extending flange portions 3*a* and 5*a* respectively, which extend beyond the casing 1 and provide axial support for the filter membrane 2.

Internally the casing 1 supports an axially spaced array of three annular noise attenuating baffles 9, 10 and 11 each of which defines a central circular aperture 9*a*, 10*a* and 11*a* respectively centered on the axis of the casing 1. Each of the baffles 9, 10 and 11 curves radially inwards in the general direction of the axial outlet aperture 8 from its outer circumference which abuts against the inside of the cylindrical casing 1 to its central aperture. The arrangement is such that the axial separation of the baffles 9, 10, 11, from each other and from the end cap 3 and end flange 5, defines a series of four annular inlet flow passages 12–15 which split the inlet flow into the silencer/filter into four respective partial flows. The central apertures 9*a*, 10*a* and 11*a* of each baffle 9, 10 and 11 have the same diameter, which corresponds to the internal diameter of the annular end flange 5 and thus of the outlet aperture 8, which together define a central axial outlet flow passage to the outlet aperture 8. It will thus be appreciated that the partial flows through the annular inlet passages 12–15 combine at the central axial passage into a single axial flow indicated generally by reference arrow 16.

Each of the baffles 9, 10 and 11, the end cap 3, and the end flange 5 have the same general construction comprising a layer of acoustic material sandwiched between a pair of perforated steel support flanges shaped appropriately. As shown, the perforations 11*e*, 10*e*, and 9*e* are circular. They may be formed in other shapes depending on the construction of the baffles 11, 10 and 9. Each pair of perforated support flanges may be suitably secured together. Each of the baffles 9–11 comprises a radially inwardly curved annular acoustic element 9*b*, 10*b* and 11*b* respectively, supported between upstream and downstream steel supporting flanges 9*c*/9*d*, 10*c*/10*d*, and 11*c*/11*d*, which match the curvature of the acoustic material elements 9*b*–11*b* (all of which have the same curvature).

It will be seen that the opposing surfaces of each baffle 9–11 have the same curvature and that the curvature of that portion of the internal surface of the end cap 3 facing baffle 11 matches the curvature of the baffle 11 and that the curvature of the inner surface of the end flange 5 facing the baffle 9 has the same curvature as the baffle 9. Thus, each of the annular inlet flow passages 12–15 has the same curvature which is initially tangential to a plane perpendicular to the central axis of the casing 1 (corresponding to the outlet flow direction 16) and which curves continuously in the direction of the outlet aperture 7 as it approaches the central axial flow passage 16.

In addition, it will be seen that the baffles 9–11 are not equi-spaced along the axis of the silencer but rather are spaced so that the axial width of the flow passages 12–15 decrease towards the inlet, in other words the axial width of flow passage 13 is less than that of flow passage 12, the axial width of flow passage 14 is less than that of flow passage 13 and the axial width of flow passage 15 is less than that of flow passage 14.

The configuration of the flow passages 12–15 resulting from the design and positioning of the baffles 9–11 and end cap 3 and end flange 5 provides significant improvements in sound attenuation and reductions in downstream turbulence in the inlet of the compressor. Two important features that contribute to this improved performance are the curvature of the passages 12–15 and the gradation in axial width of the passages.

Firstly, the curved passages 12–15 defined by the curved baffles 9–11, and similarly the curved configuration of the end cap 3 and end flange 5, provide a greater surface area available for sound dampening than will be provided by similarly disposed "flat" baffles (and thus straight passages) which increases the overall noise attenuation that can be achieved within a silencer casing of a given size.

Secondly, the curvature of the passages 12–15 gradually and smoothly diverts the inlet air flow from a generally radial direction into a substantially axial direction where it merges with the axial flow 16, thus significantly reducing turbulence at that point. This both reduces noise generation and reduces turbulence in the outlet flow to the inlet of the compressor. With the design of U.S. Pat. No. 4,204,586 there is a relative sharp change in direction in the region of the curved guides provided at the internal circumference of the baffles disclosed in that patent, most of the radial width of each baffle being flat. With the baffles according to the present invention the continuous curvature of the baffles, and thus of the passages 11–15, maximises the distance over which the change in the air flow direction is spread with the result that the change is considerably less severe.

Thirdly the increase in axial width of the partial flow passages 12–15 provides a closer matching of the velocities of the inlet and outlet air flows where they merge together into the axial outlet stream 16. That is, the outlet axial airstream 16 increase in velocity along the axis of the silencer/filter towards the outlet aperture 7. If the velocity of the partial air flows through the passages 12–15 differs from the velocity of the axial airflow 16 where they meet this will inevitability result in turbulence. The velocity of each partial airflow in each passage 12–15 is dependent upon the axial width of the particular passage, the greater the axial width the lower the velocity and vice versa. Thus, by decreasing the axial width of the partial flow passages 12–15 towards the outlet it is ensured that the partial airflow through passage 15 is greater than that through passage 14 which is greater than that through passage 13 etc. Thus, varying the width of the passages 12–15 in this way allows the velocity profile of the partial airflows to be more closely matched to the velocity profile of the axial airflow 16. Indeed, by careful design of the partial passageways it is possible to very closely match the velocities and significantly reduce the downstream turbulence in the air delivered to the intake of the compressor.

The number of partial flow passages provided, and the maximum and minimum width of the passages, may be varied to suite different silencer designs and sizes and applications. The width of the smallest partial flow passage will be determined by the maximum mean air flow velocity appropriate to the particular silencer/compressor application. It is preferred that the spread of the axial width of the partial flow passages follows an arithmetic progression, and in particular the following progression has been found to provide good results:

$$Si=S_{i-1}(3^{(1/m)})$$

where S is the gap size and m is the total number of gaps (which will be determined by the size of the space envelope within the silencer and the maximum allowed pressure drop). To achieve the desired arithmetic progression the coefficient of $1^{(1/m)}$ can be varied appropriately to suit a particular silencer.

Thus, to summarise, the present invention provides both reduced noise levels and improvements in the air flow delivered to the air intake of the downstream compressor with a corresponding improvement in compressor efficiency and surge margin.

Figure 3:
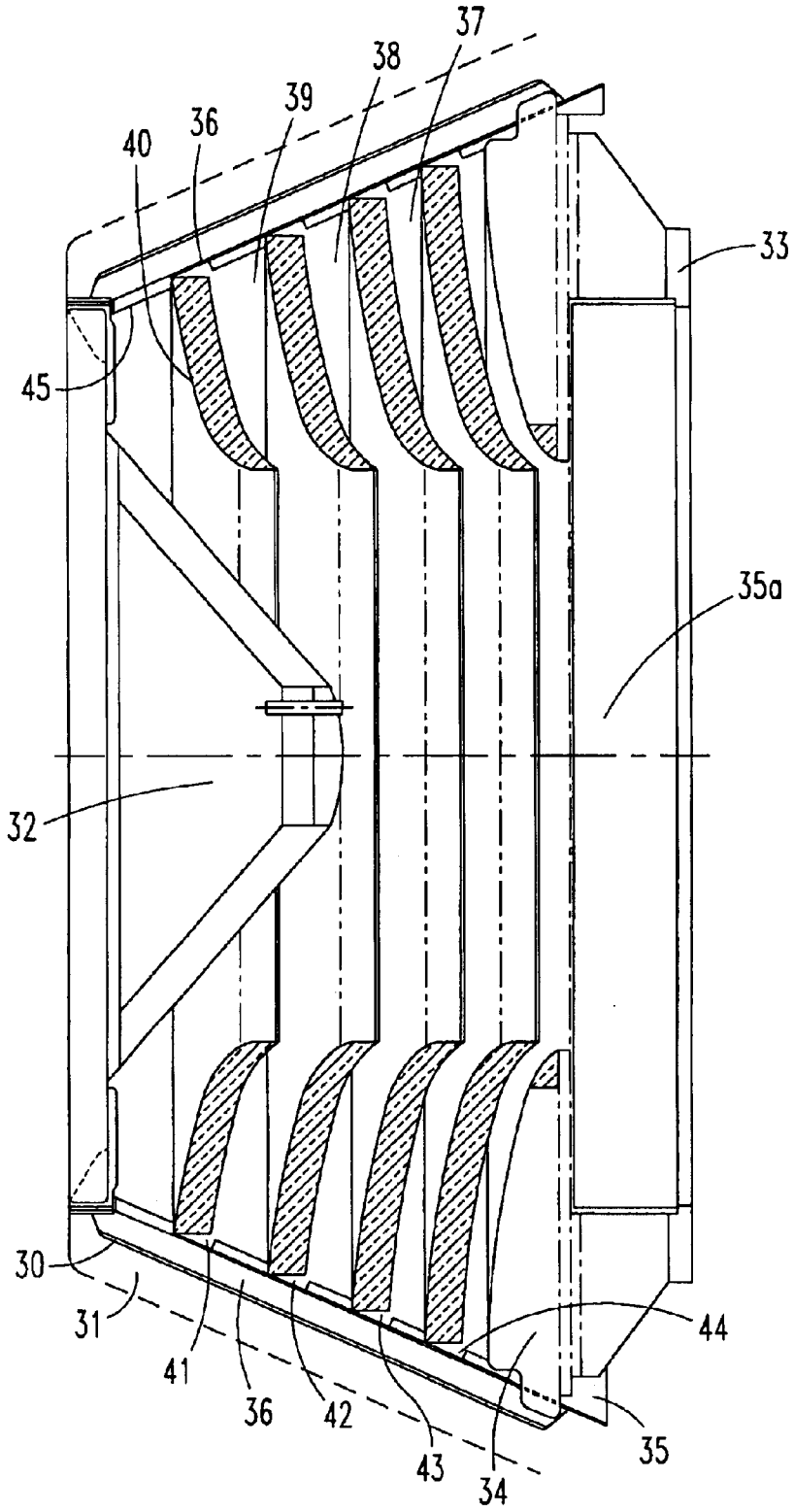
FIG. 3 illustrates a modification of the silencer/filter of FIGS. 1 and 2 which has a generally conical rather than cylindrical configuration.

Turning now to FIG. 3, this illustrates a modified construction of a compressor air inlet silencer/filter in accordance with the present invention, based on the construction of the silencer/filter described above but with a conical rather than cylindrical configuration which has greater structural strength and is thus suitable for larger units. The basic elements of the construction are otherwise very similar to those described above.

In more detail, the silencer/filter module of FIG. 3 comprises a frusto-conical shaped casing 30 which supports a similarly frusto-conical shaped filter membrane 31 on its outer surface. One end of the casing 30, the left hand end as shown in FIG. 3, is closed by an internally domed end cap 32 and the opposite end is provided with an annular connecting plate 33 for connection to the tubular inlet of an axial compressor housing. The connecting plate 33 is itself supported by an annular end flange 34 which curves radially inwardly towards an outlet aperture 35*a* defined centrally within the connecting plate 33. Additional structural rigidity is provided by a stiffening cone 35 and by longitudinal stiffening members 36 which run along the outside of the casing 30 at various positions around the circumference of the casing 30. Although not visible in FIG. 3, in the particular embodiment illustrated the stiffening members 36 have a "V" cross-section and twelve of the stiffeners are equi-spaced around the circumference of the casing 30.

The casing 30 houses an axial array of four baffles 37–40, the outer circumferences of which are received within annular channels 41–44 provided by a "laddered" conical member 45 which sits inside the casing 30. The silencer/filter is also provided with a cleaning pipe arrangement similar to that of the silencer/filter of FIG. 1 although this is not visible in FIG. 3.

It will be understood that the basic configuration and positioning of the baffles 37–40 is the same as that of the baffles 9–11 of the silencer/filter of FIG. 1 in that they define an axial array of partial inlet flow passages which curve inwardly in the direction of the outlet 35 and which decrease in axial width towards the outlet. Thus, it will be appreciated that the function of the silencer/filter is substantially the same as that of the silencer/filter of FIG. 1 in the way in which noise is attenuated and turbulence in the airflow through the silencer/filter is minimised.

It will be appreciated that many modifications may be made to the silencer/filter units described above. For instance, the configuration and construction of the casing and other elements which support the baffles and which provide the connection of the module to a compressor inlet may vary considerably. Similarly, the construction of the baffles may differ from that described provided they are constructed from a suitable material or composite materials to deaden soundwaves. For instance as opposed to the novel composite structure described, the baffles could have an essentially conventional structure comprising layers of felt or cork glued to a support plate. The precise positioning and curvature of the baffles may also vary. For example, the baffles of the embodiment of FIG. 1 have a curvature which lies substantially on the arc of a circle. The radius of curvature may vary between different silencer units. In addition the curvature need not necessarily lie on the arc of a circle. For example, it can be seen from FIG. 3 that the baffles 37–40 have a radius of curvature which increases towards the radially inner circumference of the respective baffles effectively comprising two different radiused areas merged together in a continuous curve.

It will be appreciated that whereas the embodiment of FIG. 1 has three baffles, and the embodiment of FIG. 3 has four baffles, less than three or more than four baffles may be included in any given module.

It will also be appreciated that whereas the embodiments described above combine two features of the invention, i.e. partial flow passages which are both curved and have an increasing axial width the closer the passage lies to the axial outlet, embodiments of the invention having only one of these features would provide benefits over the prior art. Thus, the invention may be embodied in a silencer which has curved equi-spaced baffles or straight baffles spaced to define flow passages which decrease in width towards the outlet.

It will also be appreciated that the novel baffle construction of the present invention could be used to produce conventionally shaped baffles for inclusion in otherwise conventional silencer designs.

It will be understood that the invention is not limited to silencers/filters intended for use with turbocharger compressors but can be applied to silencers/filters to be fitted to the air intake of any aspirated machine and for instance could be provided at the conventional air intake of an internal combustion engine. Similarly, it will be understood that whereas the illustrated embodiments of the invention are combined silencer/filter modules, filtering need not necessarily be provided. For instance, silencers according to the present invention can be constructed which provide no filtering for use in applications where filtering is not required or where filtering is performed by additional apparatus (for instance, the silencer could be constructed as a unit for installation within a cavity defined within a larger filter unit).

Other modifications will be readily apparent to the appropriately skilled person.

Having thus described the invention, what is claimed as novel and desired to be secured by Letters Patent of the United States is:

1. A silencer for connection to the air intake of a turbo machine, the silencer comprising:

a housing having an axis, an outlet aperture being defined at one axial end of the housing;

a plurality of axially spaced annular noise attenuating baffles, each baffle having an outer circumference and an inner circumference defining a central aperture, the central apertures of each baffle collectively defining an axial outlet flow passage to said outlet aperture;

the baffles defining a series of axially spaced generally annular partial flow passages such that air flowing through said silencer is initially split between said flow passages and then merges into the axial outlet passage;

wherein each of the annular flow passages curves radially inwards from its outer to its inner circumference in a direction towards the axial outlet.

2. A silencer for connection to the air intake of a turbo machine, the silencer comprising:

a housing having an axis, an outlet aperture being defined at one axial end of the housing;

a plurality of axially spaced annular noise attenuating baffles, each baffle having an outer circumference and an inner circumference defining a central aperture, the central apertures of each baffle collectively defining an axial outlet flow passage to said outlet aperture;

the baffles defining a series of axially spaced generally annular partial flow passages such that air flowing through said silencer is initially split between said flow passages and then merges into the axial outlet passage;

wherein the dimensions of the annular partial flow passages varies so that the velocity of air flow through the passages is greater for passages closer to the axial outlet aperture.

3. A silencer as claimed in claim 2, wherein each of the annular flow passages curves radially inwards towards its inner circumference in a direction towards the axial outlet.

4. A silencer as claimed in 3, wherein each of the annular flaw passages curves radially inwards from its outer to its inner circumference.

5. A silencer as claimed in claim 2, wherein each of the annular flow passages curves radially inwards from its outer to its inner circumference with a curvature which is initially tangential to a radial plane of said axis and which curves away from said plain towards its inner circumference and in a direction towards the axial outlet.

6. A silencer as claimed in claim 2, wherein each of the annular flow passages curves radially inwards with a curvature which has no sharp discontinuities.

7. A silencer as claimed in claim 2, wherein each of the annular flow passages curves radially inwards with a radius of curvature which increases towards the inner circumference of each respective flow passage.

8. A silencer as claimed in claim 2, wherein each of the annular flow passages curves radially inwards from its outer to its inner circumference in a direction towards the axial outlet and wherein each passage has the same curvature.

9. A silencer as claimed in claim 2, wherein the axial width of the annular partial flow passages increases along the axis of the housing towards the axial outlet aperture.

10. A silencer as claimed in claim 9, wherein the axial width of each annular partial flow passage differs from that of its adjacent flow passages.

11. A silencer as claimed in claim 10, wherein the relative width of the partial flow passages is adapted so that velocity of air flow through said passages is substantially matched to the velocity profile of air flowing through said axial outlet flow passage.

12. A silencer as claimed in claim 11, wherein the axial width of the annular partial flow passages increases along the axis of the housing towards the axial outlet aperture in an arithmetic progression.

13. A silencer as claimed in claim 12 wherein said arithmetic progression is:

$$Si=S_{i-1}(3^{(l/m)})$$

where S is the axial width of a particular partial passage, and m is the total number of partial passages.

14. A silencer as claimed in claim 2, wherein the inner circumference of each baffle is substantially the same.

15. A silencer as claimed in claim 2 wherein the housing has a cylindrical configuration.

16. A silencer as claimed in claim 2 wherein the housing has a substantially conical configuration, the outer circumference of each baffle differing from that of its adjacent flow passages to conform to the conical shape of the housing.

17. A combined silencer/air filter as claimed in claim 2 wherein the housing supports a filter membrane.

* * * * *